United States Patent [19]

Güntert et al.

[11] Patent Number: 4,526,150

[45] Date of Patent: Jul. 2, 1985

[54] FUEL INJECTION APPARATUS FOR INTERNAL COMBUSTION ENGINES

[75] Inventors: Josef Güntert, Gerlingen; Walter Häfele, Fellbach, both of Fed. Rep. of Germany; Helmut Pfeifle, Ecally, France; Reinhard Schwartz; Max Straubel, both of Stuttgart, Fed. Rep. of Germany

[73] Assignee: Robert Bosch GmbH, Stuttgart, Fed. Rep. of Germany

[21] Appl. No.: 585,057

[22] Filed: Mar. 1, 1984

[30] Foreign Application Priority Data

Mar. 5, 1983 [DE] Fed. Rep. of Germany ..... 3307828

[51] Int. Cl.[3] ..... F02M 39/00

[52] U.S. Cl. ..... 123/447; 123/458; 123/357; 123/509; 417/494

[58] Field of Search ..... 123/446, 447, 458, 495, 123/500, 501, 502, 357, 509, 506; 417/540, 542, 494, 499; 239/88–95, 585, 600

[56] References Cited

U.S. PATENT DOCUMENTS

| | | | |
|---|---|---|---|
| 1,993,759 | 3/1935 | Stockmeyer | 417/494 |
| 2,079,659 | 5/1937 | Olin | 417/494 |
| 2,079,821 | 5/1937 | Scribner | 417/494 |
| 2,739,643 | 3/1956 | Voit | 417/494 |
| 3,677,256 | 7/1972 | Regiveault | 123/506 |
| 3,699,939 | 10/1972 | Eckert et al. | 123/506 |
| 3,759,637 | 9/1973 | Vvaille | 123/495 |
| 4,073,275 | 2/1978 | Hofer | 417/494 |
| 4,118,156 | 10/1978 | Ivosevic | 417/494 |
| 4,378,775 | 4/1983 | Straubel et al. | 123/458 |
| 4,426,198 | 1/1984 | Bastenhof et al. | 417/494 |
| 4,461,259 | 7/1984 | Roca-Nierga | 123/506 |

FOREIGN PATENT DOCUMENTS

| | | | |
|---|---|---|---|
| 139726 | 12/1934 | Fed. Rep. of Germany | 123/506 |
| 151228 | 11/1981 | Japan | 123/458 |
| 468958 | 7/1937 | United Kingdom | 123/447 |

*Primary Examiner*—Carl Stuart Miller

*Attorney, Agent, or Firm*—Edwin E. Greigg

[57] ABSTRACT

The fuel injection quantity of a fuel injection apparatus provided with a fuel injection pump is electrically regulated by means of the opening duration of a metering valve. Additionally, a shift in the instant of supply onset controlled in accordance with operating characteristics is attained by means of a change in the return-flow fuel quantity, which is diverted into a refill reservoir and then refilled completely into the pump work chamber by the beginning of the next subsequent injection stroke. Serving as the sole connection between the refill reservoir and a pump work chamber is an overflow conduit, which is opened by two control locations on the pump piston at the end of a supply and shortly prior to the bottom dead center. Both the pump cylinder with the pressure valve and the refill reservoir and the metering valve are inserted in a leak-fuel-proof manner in a cylinder head of the pump housing, which is embodied in two parts. The decreased idle volume, the reduction of possible leakage points, and the complete refilling of the return-flow fuel quantity assure that the fuel injection quantity is determined unequivocally by the opening duration of the metering valves.

11 Claims, 11 Drawing Figures

18
38
12
25a
26
25
24
14
13
FE
OT
UT
FB
$Q_F$
$Q_R$
$Q_{RF}$
$Q_E$
a
b
$US_1$
$US_2$
$UO_2$
H
α

FUEL INJECTION APPARATUS FOR INTERNAL COMBUSTION ENGINES

BACKGROUND OF THE INVENTION

The invention is based on a fuel injection apparatus for internal combustion engines. In a fuel injection apparatus of this kind known from German Offenlegungsschrift 31 18 669, the fuel injection quantity that has been pre-stored in a pump work chamber is determined by the duration of the opening period of an electronically actuatable metering valve, and a shift in the instant of supply onset is attained, and controlled in accordance with operating characteristics, by means of a variation in the return-flow fuel quantity. This return-flow fuel quantity is adjustable by means of the controlled rotational position of the pump piston, which is provided with an oblique control edge, and in any event the pump work chamber is refilled prior to the next subsequent injection stroke. The refilling process is reinforced by a fuel reservoir that is connectable with the pump work chamber. Because of the variable volume of the fuel during its diversion and refilling, and because each operation takes place at a completely different pressure level, influences on the onset of injection and on the supply quality arise in the known fuel injection apparatus which must be compensated for in the electric control unit by mean of appropriate correction values. It is thus an object of the invention to improve the fuel injection apparatus such that the variable fuel volume during diversion and refilling does not have a disadvantageous effect on the accuracy of the controlled fuel injection quantity and the instant of supply onset. Further, the smallest possible idle volume in the vicinity of the inflow and return-flow conduit, additional errors that would be caused by escaping leaking fuel and impairments in fatigue strength that would be caused by cavitation and strains in the vicinity of the cylinder bore, the metering valve and the refill reservoir are prevented.

OBJECT AND SUMMARY OF THE INVENTION

In the fuel injection apparatus according to the invention, the return-flow fuel quantity diverted upon the end of supply is accurately refilled back into the pump work chamber, thereby precluding scattering in the supply quantity values and deviations in the instant of supply onset or at least reducing them to a value that is within the allowable tolerance. The metering pulse of the electric control unit that determines the opening duration of the metering valve thus results in an unequivocal supply quantity signal which is evaluatable in the regulating circuit of the control unit. A very substantial contribution to this improvement in function is made by the refill reservoir embodied as a piston reservoir and by the simplified conduit design, with the overflow conduit representing the sole and direct connection between the refill reservoir and the pump work chamber, which is opened by both control locations of the pump piston, so that at bottom dead center of the pump piston, whatever fuel quantity still remains in the refill reservoir after the closure of the overflow opening by the first control location is refilled back into the pump work chamber. By means of the incorporation of both the refill reservoir and the metering valve into the cylinder head of the two-part pump housing, this cylinder head also receives the pump cylinder and the pressure valve, the inevitable idle volumes and sealed locations can be reduced to a minimum. Furthermore, the lower part of the housing can be manufactured from lightweight metal to save weight and expense, while the cylinder head can be made from a high-grade material in terms of strain-, pressure- and wear-resistance, such as an appropriately selected steel. As a result, cavitation in the vicinity of the overflow conduit is avoided, and the structural length of series injection pumps can be reduced as a result of the shorter spacing between cylinders.

As a result of the provisions set forth herein, advantageous further embodiments and developments of the fuel injection apparatus are disclosed. In a fuel injection as embodied herein, the idle volumes in the vicinity of the overflow and inflow conduit can be kept very small, because for instance with horizontally disposed receiving bores for the refill reservoir and the metering valve, the bottom faces of these receiving bores can be brought very close to the pump cylinder. If the refill reservoir is parallel to the pump cylinder, then the cylinder head can be narrower in embodiment, and the diversion stream of the return-flow fuel diverted upon the end of supply does not strike the reservoir piston directly but is instead deflected, so that the energy of the emerging fuel is at least for the most part dissipated, and an overswing of the reservoir piston that could be caused by the diversion impact can be prevented. The impact sheath disclosed in claim 3 contains a substantial portion of the overflow conduit and prevents cavitation in the corresponding area of the area of the cylinder head that could be caused by the diversion stream.

In a fuel injection apparatus, in which the fuel injection pump is provided, as known from the patent cited above, with a cylinder liner containing the pump cylinder and fastened in the pump head and with an overflow bore in the wall of the cylinder liner that embodies at least a substantial portion of the overflow conduit, the design and disposition of the refill reservoir in the cylinder head as defined is capable of exerting a tensioning force upon the cylinder sheath of the refill reservoir that is sufficient to generate the required sealing force and yet precludes deformation of the cylinder liner, without putting the cylinder liner under strain.

In a fuel injection apparatus as embodied herein, any problems associated with sealing, leakage, wear and strain are eliminated by the integrated incorporation of the refill reservoir into the cylinder head that is manufactured from tempered steel.

Furthermore, with an appropriate matching of the cam drive of the fuel injection pump, embodied as a multi-cylinder pump, it is possible to use merely one metering valve for each two pump elements. The valve element required therefor, which blocks one of the pump work chambers at a time, may be embodied in accordance with claim 8 by a control face on the pump piston, so that in a particularly advantageous manner no additional structural parts are required.

The invention will be better understood and further objects and advantages thereof will become more apparent from the ensuing detailed description of the preferred embodiments taken in conjunction with the drawings.

DESCRIPTION OF THE PREFERRED EMBODIMENTS

Figure 1:
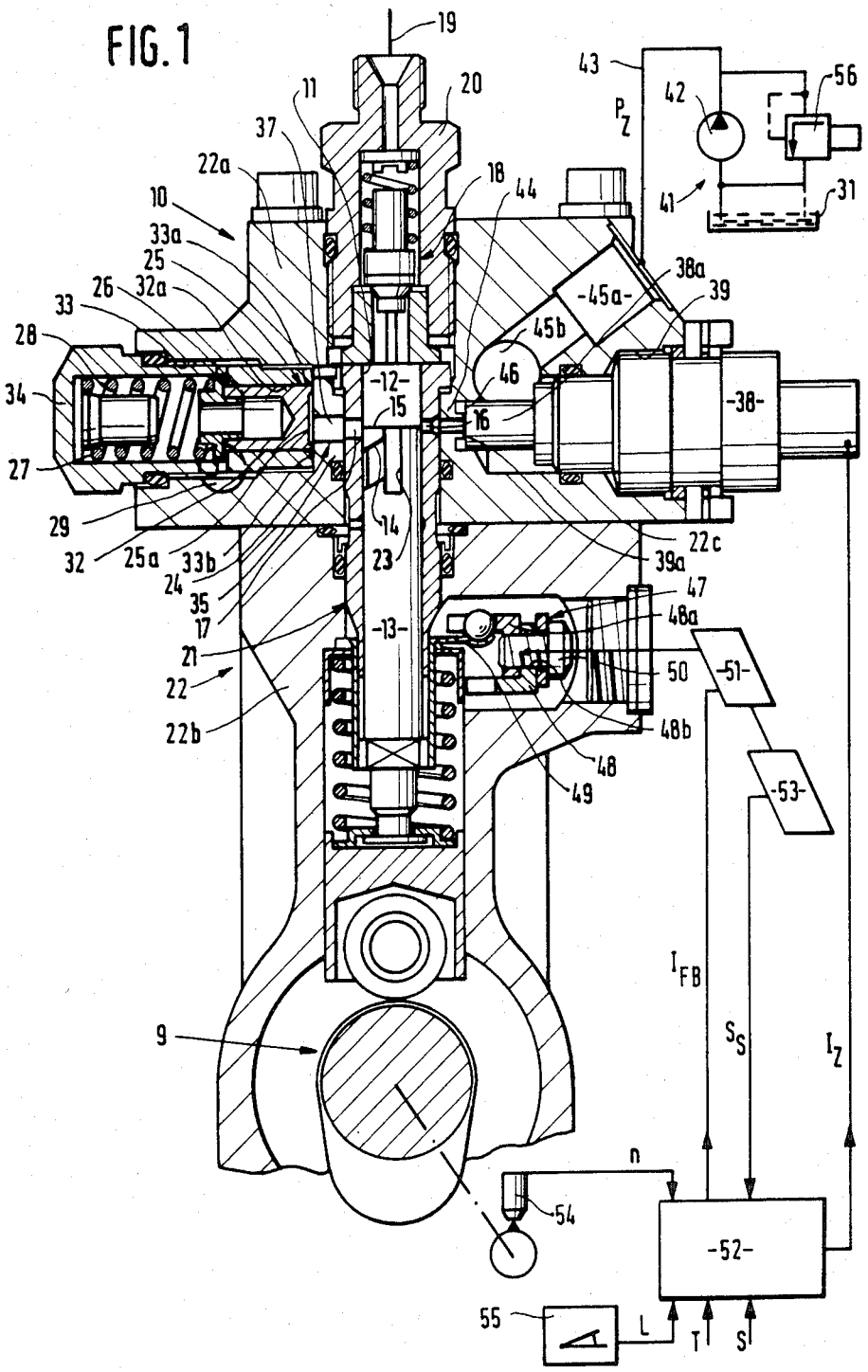
FIG. 1 is a simplified illustration of the first exemplary embodiment of a fuel injection apparatus according to the invention, having a fuel injection pump embodied as a series injection pump and shown in cross section.

FIG. 1 shows, as a first and preferred exemplary embodiment, a fuel injection pump 10 embodied as a series injection pump, which is shown in a cross-sectional view taken through a pumping element and has a pump piston 13 which is guided such as to be both axially and rotationally movable in a pump cylinder 11 and which defines a pump work chamber 12. The pump piston 13 is actuatable in the reciprocating direction by a cam drive 9; on its jacket face, the pump piston 13 has two control locations, of which one comprises an oblique control edge 14 cut into the jacket face of the pump piston 13 and the other of which comprises a horizontal control edge 15 embodied by the end face of the pump piston 13 toward the pump work chamber.

In the bottom dead center position (marked UT in the drawings) of the pump piston 13, an inflow conduit 16, which is closed by the jacket face of the pump piston 13 during pump supply, and a diametrically opposed overflow bore 17 of an overflow conduit 24 discharge into the pump work chamber 12, which is closable in the supply direction by a pressure valve 18 and is connectable via a pressure line 19, merely suggested in the drawing, with an injection nozzle, not shown.

The pump cylinder 11, in the exemplary embodiment shown in FIG. 1, is embodied as a cylinder bore of a cylinder liner 21 secured by means of a screw pipe joint 20 in a cylinder head **22*a* of a pump housing 22. The pump work chamber 12 defined inside the pump cylinder 11 by the pump piston 13 and the pressure valve 18 is connectable, in order to terminate the effective supply stroke that is controlled by the oblique control edge 14, via a stop groove 23 and the overflow conduit 24 with a refill reservoir 25** serving as a fuel reservoir.

Although a volume reservoir is also conceivable as a receptacle for the return-flow fuel quantity, a piston reservoir is used here in order to attain high accuracy in metering the quantity; this piston reservoir has a reservoir chamber **25*a* and a reservoir piston 26 acting as a movable wall, which is displaceable counter to the force of a compression spring 27 serving as a restoring means. A spring chamber 28 containing the spring 27 and disposed on the end of the reservoir piston 26 remote from the reservoir chamber 25*a* communicates via the relief line 29 in a manner not shown in detail with a fuel tank 31. The reservoir chamber 25*a* and a sliding guide for the reservoir piston 26 are embodied by a cylinder bore 32*a* of a cylinder sheath 32. This cylinder sheath 32 is firmly pressed by means of a hollow screw 34, which contains the spring chamber 28 of the restoring spring 27, against a contact shoulder 33*a* in the outer region of a bottom face 33*b* of a first receiving bore 33 inside the cylinder head 22*a*. The receiving bore 33 for the refill reservoir 25 is embodied as a blind bore extending toward the axial center of the pump cylinder 11 and extending from the outside into the cylinder head 22*a*; its bottom face 33*b* is divided from the pump cylinder 11 solely by a wall area 35 through which only the overflow conduit 24 passes. The components of this wall area 35 are a wall of the cylinder liner 21 that is penetrated by the overflow bore 17 and a wall in the cylinder head 22*a* that is penetrated by a connecting bore 37 and is defined toward the outside by the bottom face 33*b*. The overflow bore 17 and the connecting bore 37 together comprise the overflow conduit 24**.

The pump housing 22 comprises two housing parts, threaded together in a plane of division **22*c* extending at right angles to the longitudinal axis of the pump piston 13, specifically the cylinder head 22*a*, which receives the cylinder liner 21, the pressure valve 18 and the refill reservoir 25, and a lower housing part 22*b*, which receives the cam drive 9 and an adjusting device 47 to be described in detail later herein; the lower housing part 22*b* is made of aluminum to save weight, while the cylinder head 22*a*** is made of steel and is therefore capable of withstanding greater stresses in terms of wear, pressure and strain.

Diametrically opposite from the refill reservoir 25, a metering valve 38 which is electromechanically actuatable and is embodied as a magnetic valve is inserted in a pressure-tight manner into a second, multiple-step receiving bore 39 of the cylinder head **22*a***.

This receiving bore 39 for the metering valve 38 is, like the first receiving bore 33, embodied as a blind bore extending at least approximately toward the axial center of the pump cylinder 11 and extending from the outside into the cylinder head 22; its bottom face **39*a* is separated form the pump cylinder 11 by a wall area 44 located partly in the cylinder head 22*a* and partly in the cylinder liner 21**.

The metering valve 38 supplies the pump work chamber 12 via the inflow conduit 16 with fuel pumped from a low-pressure source 41 and with its opening duration (b in FIG. 6) determines a fuel injection quantity that is pre-stored in the pump work chamber 12.

The low-pressure source 41 contains a feed pump 42, which aspirates the fuel out from the fuel tank 31 and pumps it via an inflow line 43 and inflow bores **45*a* and 45*b*, as well as via the metering valve 38 and the inflow conduit 16, into the pump work chamber 12 whenever the pump piston is in its bottom dead center position shown in FIG. 1**.

In order to prevent the escape of leaking fuel at the point connecting the metering valve 38 and the inflow conduit 16, a mouthpiece **38*a* of the metering valve 38 is sealed off at the end face, in the vicinity of the bottom face 39*a*, by means of a sealing ring 46**.

For correcting or adjusting the end of the effective supply stroke of the pump piston 13, the fuel injection pump 10 is equipped with an adjusting device 47, which in a known manner comprises a longitudinally displaceable regulating rod 48 and a steering sheath 49 for the pump piston 13 that is actuatable by the regulating rod 48. The regulating rod 48 is provided with couplers **48*a* secured by screws 50, which couplers 48*a* are adjustable and fixable in oblong slots 48*b* of the regulating rod 48** in order to synchronize the pump elements. Both parts 48 and 49 of the adjusting device 47 serve, upon a longitudinal movement of the regulating rod 48 effected by means of an adjusting member 51, to cause the rotation of the pump piston 13, as a result of which the relative position between the overflow bore 17 and the oblique control edge 14 on the pump piston 13 varies.

The adjusting member 51 actuating the regulating rod 48, as an electromechanical adjusting member, is embodied by an electromagnet, an electric servomotor or an electrohydraulic adjusting member, depending on the adjusting force required, and it receives its control pulse $I_{FB}$, which is dependent on at least one operating characteristic, such as the load L or the rpm n, from an electric control unit 52. The change in the rotational position of the oblique control edge 14 attainable with the adjusting device 47, and thus the change in the end of supply, does not, however, in this case determine the fuel injection quantity $Q_E$, but serves instead, in combination with the function of the refill reservoir described in detail above, to vary the instant of supply onset. The position of the adjusting member 51 at a given time is measured by an adjusting-path transducer 53 and fed to the control unit 52 in the form of an adjusting-path signal $S_S$.

With its opening duration, the metering valve 38 embodied as a magnetic valve determines a fuel injection quantity pre-stored in the pump work chamber 12, which quantity corresponds exactly to the fuel quantity $Q_E$ that is to be injected. The magnetic valve 38, embodied in a known manner as a 2/2-way valve, receives a metering pulse $I_Z$ that determines its opening duration from the control unit 52, which contains an electronic regulating circuit, and into which in addition to an rpm signal n emitted by an rpm transducer 54, additional signals dependent on engine operating characteristics are also fed, such as a temperature signal T derived from a suitable location and further signals S. A load signal L to be fed in by a person operating the engine is generated by a set-point value feed means 55.

The fuel metering controlled by the magnetic valve 38 is effected at a constant fuel inflow pressure $p_Z$ via a constant inflow cross section, embodied for instance by the first cross section in the inflow conduit 16, at a variable opening duration of the magnetic valve 38 determined by the metering pulse $I_Z$. The constant inflow cross section may also be embodied by the flow-through cross section of the magnetic valve 38. The constant inflow pressure $p_Z$ is maintained by means of a pressure regulating valve 56 located in the low-pressure source 41. The metering pulse $I_Z$ determining the opening duration thus results in an accurate supply quantity signal.

Figure 2:
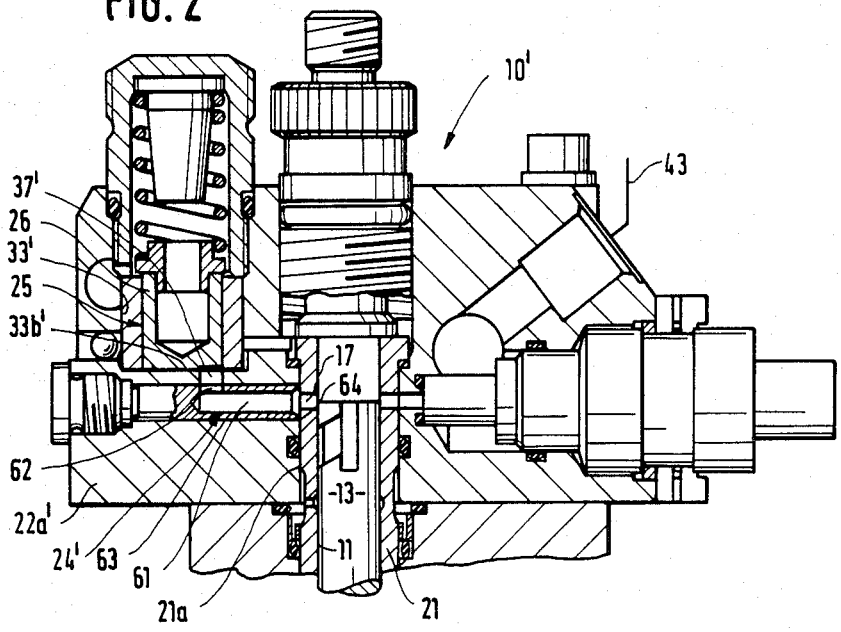
FIG. 2 is a partial cross section through the components of a fuel injection pump that are essential to the invention, in terms of a second exemplary embodiment.

In the second exemplary embodiment, shown in part in FIG. 2, of a fuel injection pump 10' of the fuel injection apparatus according to the invention, the sole difference from the fuel injection pump 10 shown in FIG. 1 is the differing manner in which the refill reservoir 25 and metering valve 38 are mounted. Identical elements are therefore identified by the same reference numerals, while differing elements have the same reference numeral with a prime, and new parts are identified by a new reference number. (In further exemplary embodiments, the reference numerals are correspondingly given double and triple primes.)

The first receiving bore, marked 33' in FIG. 2, for the refill reservoir 25 is embodied as a blind bore drilled from outside into the cylinder head 22a' parallel to the pump cylinder 11, into the bottom face 33b of which a connecting bore 37', serving as part of the overflow conduit 24', discharges. A substantial portion of the overflow conduit 24' is embodied by a longitudinal bore 61 and a transverse bore 62, directly adjoining the connecting bore 37', inside an impact sheath 63. This impact sheath 63 is made of wear-resistant material, such as tempered steel, and is inserted into the cylinder head 22a radially with respect to the pump cylinder 11. In this exemplary embodiment, the overflow conduit 24' thus comprises the overflow bore 17 in the cylinder liner 21, the longitudinal bore 61 and transverse bore 62 in the impact sheath 63, and the connecting bore 37' in the cylinder head 22a'. Both the longitudinal bore 61 in the impact sheath 63 and the transverse bore 62, diverging at right angles from the longitudinal bore 61, serve to dissipate the energy of the fuel stream emerging from the overflow bore 17 at the end of injection. The deflection toward the connecting bore 37' damps the diversion impact so greatly that even at very high rpm the reservoir piston 26 of the refill reservoir 25 does not start to oscillate. An end face 64 of the impact sheath 63 oriented toward the pump cylinder 11 is embodied as a sealing face resting in a positively-engaged manner on a cylindrical jacket face 21a of the cylinder liner 21 and being pressed against this jacket face 21a.

Figure 3:
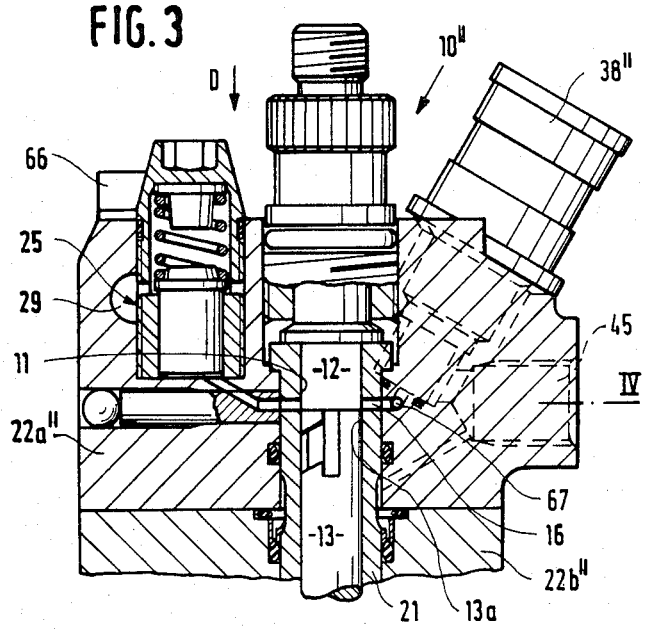
FIG. 3 is a partial cross section taken along the line III—III in FIG. 4, similar to FIG. 2, but for the third exemplary embodiment, in which one metering valve is associated with two pump cylinders.

In the third exemplary embodiment of a fuel injection pump 10'' shown in FIG. 3, the refill reservoir 25 is incorporated into the cylinder head 22a'' parallel to the longitudinal axis of the pump piston, as in FIG. 2. In this fuel injection pump 10'', which is also shown in plan view in FIG. 4, two pump work chambers 12 at a time are supplied with fuel by a single metering valve 38''. The oblique mounting of the metering valve 38'' makes possible a very narrow and compact structure on the part of the injection pump; furthermore, the refill reservoir 25 is also brought very close to the cylinder liner 21.

Figure 4:
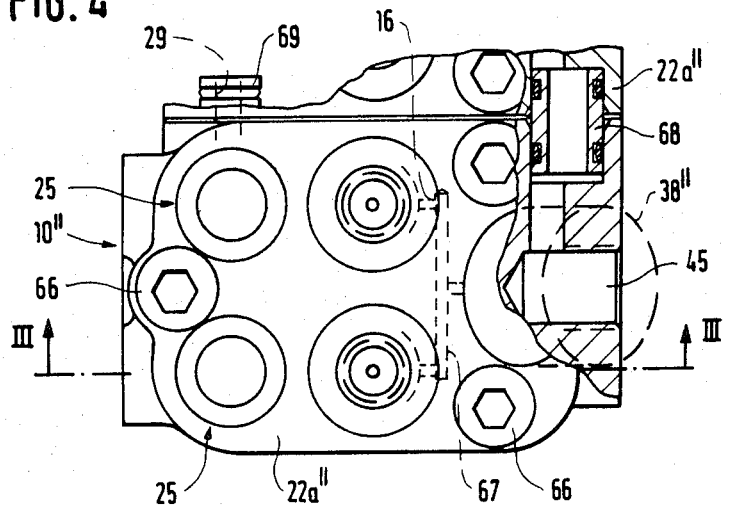
FIG. 4. is a plan view in the direction of the arrow D in FIG. 3 onto the cylinder head.

As shown in FIG. 4, two pump elements and two associated refill reservoirs 25 at a time are accommodated in one steel cylinder head 22a''. In a four-cylinder series injection pump, two double cylinder heads 22a'' are thus mounted onto a single lower housing part 22b'' and connected therewith by fastening screws 66. The metering valve 38'' that is common to two pump cylinders 11 at a time delivers the metered fuel injection quantity via a bore arrangement 67, shown in dashed lines in FIG. 4, in the respective cylinder head 22a'' to the inflow conduits 16 of the respective pump cylinder 11. The inflow bores 45 of the two cylinder heads 22a'' shown in FIG. 4 are, like the relief lines 29, connected with one another via appropriately sealed plug-in sleeves 68 and 69 at the resprective junctions of two cylinder heads 22a''. The control effected by the associated cam drive (see 9 in FIG. 1) is designed such that only one of the two adjacent pump work chambers 12, for instance the one shown in FIG. 3, at a time is connected with the associated metering valve 38''. At the same time the inflow conduit 16 to the other pump work chamber, that is, the one not shown in FIG. 3, is blocked by a control face 13a on the corresponding pump piston 13 acting as a valve element. The control face 13a on the pump piston 13 shown in Fig, 3, which is in its bottom dead center position, keeps the inflow conduit 16 from the metering valve 38'' or from the bore arrangement 67 open to the pump work chamber 12 in this operating position.

Nevertheless, metering by one metering valve 38" to a plurality of pump work chambers 12 can also be realized without the valve elements (13*a*), if for instance all the associated pump pistons 13 are at bottom dead center and precisely matched throttling cross sections in the inflow conduits 16 assure uniform distribution of the metered fuel to the individual pump work chambers 12. The control described in the third exemplary embodiment (shown in FIGS. 3 and 4) does, however, advantageously guarantee a precise individual metering to each pump work chamber 12.

Figure 5:
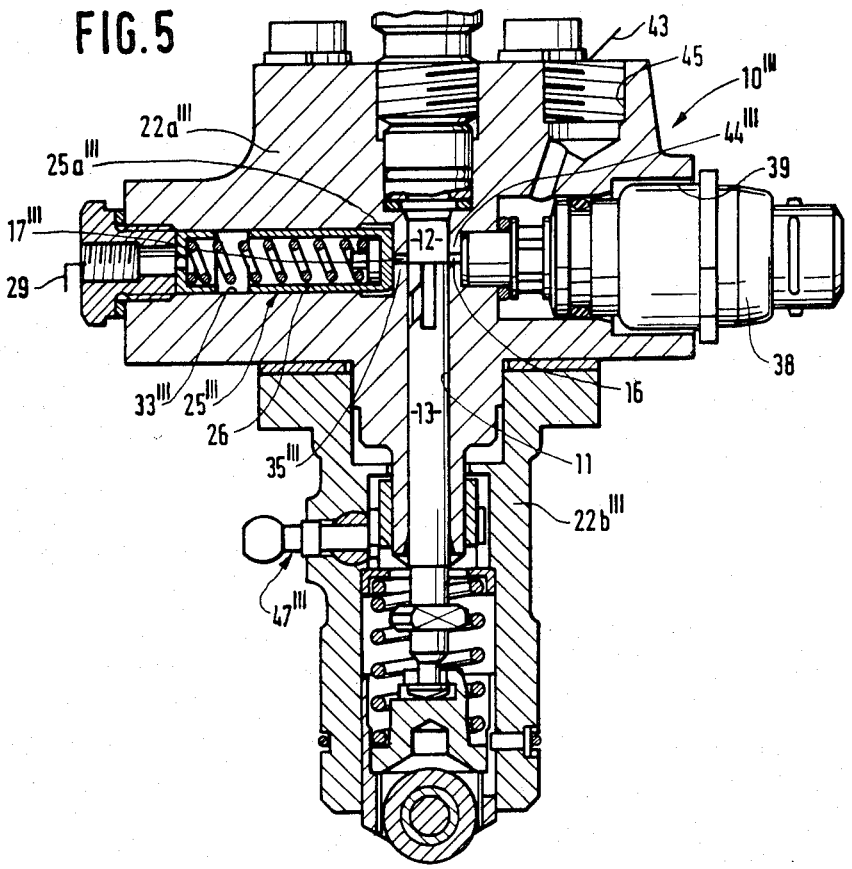
FIG. 5 is a cross section taken through a fourth exemplary embodiment, embodied as a plug-in pump.

The fourth exemplary embodiment, shown in FIG. 5, has a fuel injection pump 10''' embodied as a plug-in pump and driven by a camshaft, not shown, located on the engine. The cylinder head 22*a*''' mounted onto the lower housing part 22*b*'' assumes the function of the cylinder liner 21 used in the foregoing exemplary embodiments and is thus for reasons of wear and fracture resistance made of steel tempered at least at the points subject to heavy strain, such as is otherwise used for cylinder liners. The tempered receiving bore 33''' receiving the refill reservoir 25''' embodies both the reservoir chamber 25*a*''' and a sliding guide for the reservoir piston 26. Since no specialized cylinder liner is present in this embodiment, the reservoir chamber 25*a*''' can be brought very close to the pump work chamber 12 in the cylinder bore 11, in order to reduce the idle volume. The overflow bore, marked here as 17''', simultaneously acts as the overflow conduit. The wall area 35''' dividing the reservoir chamber 25*a*''' from the pump work chamber 12 is, like the corresponding wall area 44''' receiving the inflow conduit 16, located exclusively in the cylinder head 22*a*'''. Thus in order to avoid cavitation wear this wall area 35''' can be tempered in the vicinity of the conduits 17''' and 16 and has no additional sealing points. The lower housing part 22*b*''' of this injection pump 10''', which is embodied as a plug-in pump and is therefore provided with only one pump piston 13, contains an adjusting device 47''' known per se and differing in structure from the foregoing embodiments. Differing from the structure shown, however, it is also possible to embody double cylinder heads in the corresponding manner, which can then also be used in multi-cylinder series injection pumps.

Figures 6, 6A, 6B, 6C, 6D, 6E:
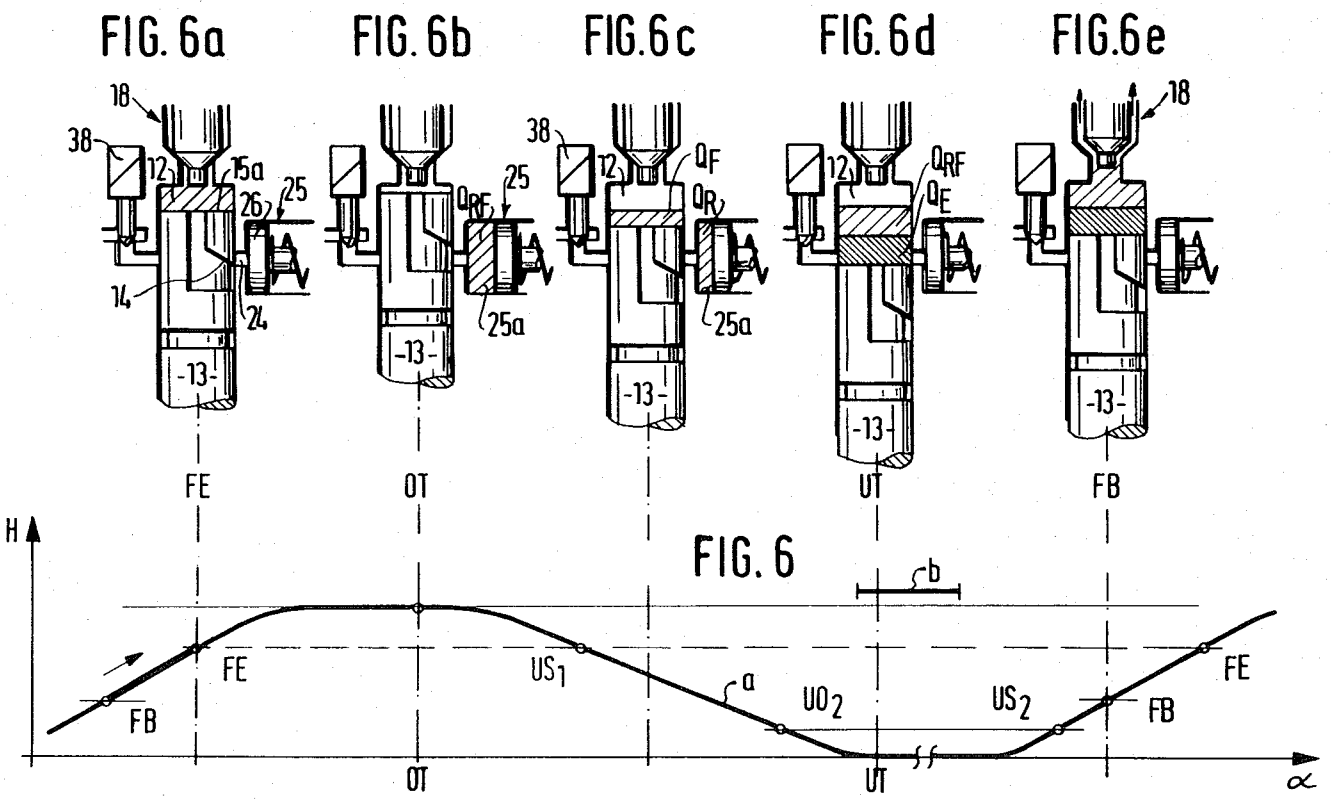
FIG. 6 is a function di for the piston stroke, with subdiagrams FIGS. *6a–6e* showing the respective positions of the piston, refill reservoir, metering valve and pressure valve and the associated fill status in the pump work chamber and the refill reservoir.

The diagram shown in FIG. 6 shows a curve a representing the piston stroke H plotted over the cam angle $\alpha$ and includes sub-FIGS. 6*a*–6*e* in which the position at a given time of the pump piston 12, the reservoir piston 26, the metering valve 38 and the pressure valve 18, as well as the fill status at a given time in the pump work chamber 12 are all shown in simplified form. The piston stroke H is plotted to a double-size scale, while the cam angle $\alpha$ is plotted not to scale because of the associated FIGS. 6*a*–6*e*. A horizontal bar b shown in the vicinity of bottom dead center UT above the curve a represents the opening duration of the metering valve 38. The points for the supply onset FB and end of supply FE as well as the points $US_1$ and $UO_2$, standing respectively for the instant when the overflow conduit 24 is closed by the oblique control edge 14 and for the instant when this overflow conduit 24 is opened by the horizontal control edge 15, are plotted on the curve a. The instant of closing of the overflow conduit 24 by the horizontal control edge 15 located after UT is represented by $US_2$, while the instant when this conduit 24 is opened by the oblique control edge 14 occurs simultaneously with the end of supply at point FE. The associated positions of the pump piston 13 are again shown for FIGS. 6*a*, 6*b*, 6*d* and 6*e* below the piston 13. In FIG. 6*c*, the pump piston 13 assumes a position between the closing instant $US_1$ and the opening instant $UO_2$, and the fill status shown in the pump work chamber 12 and the reservoir chamber 25*a* is already attained shortly after $US_1$. The entire return-flow fuel quantity $Q_{RF}$ as well as a partial quantity $Q_F$ of $Q_{RF}$ and a remnant quantity $Q_R$ are shown by shading, and the fuel injection quantity $Q_E$ metered by the metering valve 38 is shown by double shading.

The mode of operation of the subject of the application will now be described with the aid of FIGS. 1 and 6 in terms of the first exemplary embodiment. The exemplary embodiments shown in FIGS. 2–5 function in the same manner and differ only in their structural details.

In FIG. 1, the pump piston 13 is shown in its bottom dead center position UT corresponding to FIG. 6*d*, and the entire return-flow fuel quantity $Q_{RF}$ and the fuel injection quantity $Q_E$ pre-stored by the metering valve 38 are contained in the partially evacuated pump work chamber 12. After the horizontal control edge 15*a* has closed the inflow opening 16 and, at $US_2$, the overflow conduit 24 as well, the onset of supply is initiated at FB during the further upward stroke of the pump piston 13. The injection takes place until point FE, with the pressure valve 18 permitting the flow of fuel to the injection nozzle (see FIG. 6*e*). The end of supply FE is controlled by the opening of the overflow conduit 24 by the oblique control edge 14*a* (see FIG. 6*a*), and up to top dead center OT the pump piston 13 positively displaces the entire return-flow fuel quantity $Q_{RF}$, the pressure valve 18 being closed, into the reservoir chamber 25*a* of the refill reservoir 25 (see FIG. 6*b*). During the return or aspiration stroke of the pump piston 13, until the closure of the overflow conduit 24 by the oblique control edge 14, a partial quantity $Q_F$ of the return-flow fuel quantity stroke of the pump piston 13, until the closure of the overflow conduit 24 by the oblique control edge 14, a partial quantity $Q_F$ of the return-flow fuel quantity $Q_{RF}$ is refilled or re-aspirated into the pump work chamber 12. Because of the differing compression volume at the end of supply and during the intake stroke, a remnant quantity $Q_R$ remains in the reservoir chamber 25*a* (see FIG. 6*c*). This remnant quantity $Q_R$ is refilled into the pump work chamber 12 after the opening instant $UO_2$ of the overflow conduit 24 and until bottom dead center UT of the pump piston 13, so that at UT the entire return-flow fuel quantity $Q_{RF}$ is again present and available in the pump work chamber 12. In the range between $UO_2$ and $US_2$, and if possible at UT, the fuel injection quantity $Q_E$ is pre-stored into the pump work chamber 12 during the opening period of the metering valve 38 that is defined by the metering pulse $I_Z$ of the control unit 52 and indicated at b in FIG. 6. Between US and FB, a partial vacuum remaining in the pump work chamber 12 is compressed, and the subsequent fuel injection then begins at FB (see FIG. 6*e*).

The control of the end of supply FE by the corresponding rotational position of the oblique control edge 14 or by the change in rotational position of the pump piston 13 by means of the adjusting movement of the edge 14 or by the change in rotational position of the pump piston 13 by means of the adjusting movement of the regulating rod 48 effected by means of the electromechanical adjusting member 51 determines the instant of supply onset FB by means of the return-flow fuel quantity $Q_{RF}$ that is diverted and then refilled. If the opening duration of the metering valve 38 controlled by the metering pulse $I_Z$ of the control unit 52 is varied, then the adjusting member 51 is also followed up, by means of an appropriate correcting pulse of the control unit 52, at an appropriately adapted adjusting speed and the return-flow fuel quantity is corrected, so that the instant of supply onset FB remains constant. If however the instant of supply onset FB is to be varied in accordance with the rpm n or the load L or other operating characteristics, while the injection quantity $Q_E$ remains the same, then all that is done is that a different rotational position of the pump piston 13 is established by means of the adjusting device 47. For precise regulation of this rotational position, the adjusting member 51 is provided with the adjusting-path transducer 54, which emits an adjusting-path signal $S_S$ to the electrical control unit 52; this transducer 54 is merely suggested in FIG. 1 and may be disposed an any arbitrary location, for instance on the regulating rod 48 instead, and embodied by a known travel-path transducer operating capacitively, inductively or in some other manner.

The differing mode of operation of the third exemplary embodiment in terms of the metering, in which the fuel is metered to a plurality of pump work chambers 12 by means of a single metering valve 38'', has already been explained in sufficient detail in the description of FIGS. 3 and 4.

The fuel injection apparatus described in terms of four exemplary embodiments and provided with a series injection pump may also contain, instead of the fuel injection pump 10, 10', 10'' or 10''', pump/nozzles that have been combined into a modular unit with the injection nozzle. The operational principle of the fuel injection apparatus according to the invention can also be applied, being adapted accordingly, to distributor injection pumps.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection apparatus for internal combustion engines, comprising at least one pump piston guided inside a pump housing of a fuel injection pump in an axially and rotationally movable manner in a pump cylinder and acting upon a pump work chamber between said pump piston and a supply pressure valve, said piston being actuated by a cam drive, the pump piston being provided with first and second control locations axially offset from one another, of which said first control location is embodied by an oblique control edge and in order to terminate the effective supply stroke opens an overflow conduit disposed separately from an inflow opening in the pump cylinder and upon the return stroke of the pump piston enables a refilling of the return-flow fuel quantity that had been diverted from said chamber following the end of supply and thereby fixes the instant of supply onset;

a fuel reservoir connectable with the pump work chamber via the overflow conduit;

said pressure supply valve closing off the pump work chamber on the supply side;

an adjusting device serving to rotate the pump piston and actuatable by a mechanical adjusting member;

an electromechanically actuatable metering valve supplying the pump work chamber with fuel via the inflow conduit, said metering valve, with its opening duration, determining a fuel injection quantity pre-stored in the pump work chamber;

said fuel reservoir embodied as a refill reservoir receiving the entire return-flow fuel quantity diverted after the end of supply and forcing the entire return-flow fuel quantity back into the pump work chamber prior to the next subsequent supply stroke, the refill reservoir including a reservoir chamber and a reservoir piston displaceable therein counter to the force of a restoring spring; said reservoir piston including a bottom facing towards said pump work chamber and filling an end portion of said reservoir chamber facing said pump work chamber when in its nondisplaced position;

said overlow conduit representing the sole and direct connection between the refill reservoir and the pump work chamber and openable by said first and second control locations of the pump piston;

the pump housing comprising two housing parts threaded together in a plane of division extending at right angles to the longitudinal axis of the pump piston, said two housing parts being, respectively a lower housing part which receives at least the adjusting device, and a cylinder head which receives at least the pump cylinder and the supply pressure valve; and the cylinder head also, including a first receiving bore connected to the overflow conduit which receives the refill reservoir and, a second receiving bore which communicates with the inflow conduit, and contains the metering valve.

2. A fuel injection apparatus as defined in claim 1, in which the two receiving bores for the refill reservoir and the metering valve are embodied as blind bores oriented at least approximately toward the axial center of the pump cylinder and extending from outside into the cylinder head, the bottom faces of said blind bores are each divided from the pump cylinder by respective wall areas penetrated only by the overflow conduit and by the inflow conduit.

3. A fuel injection apparatus as defined by claim 1, in which the first receiving bore for the refill reservoir is embodied as a blind bore extending from outside into the cylinder head parallel to the pump cylinder extending, into the bottom face of which blind bore a connecting bore serving as a portion of the overflow conduit discharges.

4. A fuel injection apparatus as defined by claim 3, in which a substantial portion of the overflow conduit is embodied by a longitudinal bore and a transverse bore connected to the connecting bore, inside an impact sheath inserted into the cylinder head radially with respect to the pump cylinder and manufactured of wear-resistant material.

5. A fuel injection apparatus as defined by claim 1 including a cylinder liner containing the pump cylinder and secured in the pump housing and the fuel injection apparatus also having an overflow bore in the wall of the cylinder liner, said overflow bore being a portion of the overflow conduit in the cylinder liner secured in the cylinder head, and the refill reservoir including a cylinder sheath firmly pressed by means of a hollow screw against a contact shoulder in the first receiving bore of the cylinder head, the cylinder bore of the cylinder sheath forming the reservoir chamber and a sliding guide for the reservoir piston, and the hollow screw containing a spring chamber for the restoring spring.

6. A fuel injection apparatus as defined by claim 4 further comprising a cylinder liner containing the pump cylinder and secured in the pump housing and the fuel injection apparatus also having an overflow bore in the wall of the cylinder liner, which bore embodies a portion of the overflow conduit in which the cylinder liner is secured in the cylinder head, and the refill reservoir including a cylinder sheath firmly pressed by means of a hollow screw against a contact shoulder in the first receiving bore of the cylinder head, the cylinder bore of the cylinder sheath forming the reservoir chamber and a sliding guide for the reservoir piston, and the hollow screw containing a spring chamber for the restoring spring, and an end face of the impact sheath oriented toward the pump cylinder is embodied as a sealing face resting in a positively-engaged manner on a cylindrical jacket face of the cylinder liner and being pressed against this jacket face.

7. A fuel injection apparatus as defined by claim 1, which the cylinder head is of tempered steel, and that the tempered receiving bore receiving the refill reservoir forms both the reservoir chamber and a sliding guide for the reservoir piston.

8. A fuel injection apparatus as defined by claim 2, in which the cylinder head is of tempered steel, and that the tempered receiving bore receiving the refill reservoir forms both the reservoir chamber and a sliding guide for the reservoir piston.

9. A fuel injection apparatus as defined by claim 3 in which the cylinder head is of tempered steel, and that the tempered receiving bore receiving the refill reservoir forms both the reservoir chamber and a sliding guide for the reservoir piston.

10. A fuel injection apparatus as defined by claim 1, wherein the fuel injection pump is embodied as a multi-cylinder pump, in which the head is formed of steel and includes at least two pump cylinders, and two pump work chambers, each connected with one refill reservoir, and can be supplied with metered fuel by a single metering valve, with only one of the pump work chambers being connectable at a time with the metering valve, while the inflow conduit to the other pump work chamber is blocked by a valve element.

11. A fuel injection device as defined by claim 10, in which the pump piston has a control face, which in only one of the two bottom dead center positions (UT) opens up the connection between the inflow conduit and the pump work chamber, and in which the valve element is embodied by the control face on the pump piston.

* * * * *